US006060836A

United States Patent [19]

Maeno et al.

[11] Patent Number: 6,060,836

[45] Date of Patent: May 9, 2000

[54] PLASMA GENERATING APPARATUS AND ION SOURCE USING THE SAME

[75] Inventors: Shuichi Maeno; Yasunori Ando; Yasuhiro Matsuda, all of Kyoto, Japan

[73] Assignee: Nissin Electric Co., Ltd., Kyoto, Japan

[21] Appl. No.: 09/023,719

[22] Filed: Feb. 13, 1998

[30] Foreign Application Priority Data

Feb. 14, 1997 [JP] Japan ..... 9-047297

[51] Int. Cl.[7] ..... H05B 37/02

[52] U.S. Cl. ..... 315/111.21; 250/423 R; 315/111.81

[58] Field of Search ..... 250/423 R, 426; 315/111.21, 111.31, 111.81

[56] References Cited

U.S. PATENT DOCUMENTS 4,980,610 12/1990 Varga ..... 315/111.21
5,677,597 10/1997 Tanaka ..... 315/111.21

FOREIGN PATENT DOCUMENTS 7-46586 5/1995 Japan .

OTHER PUBLICATIONS

Eitaro Abe, "Microwave Technology," Tokyo University Shuppan–Kai, Nov. 30, 1985, 3rd Impression of 1st ed.

*Primary Examiner*—Michael B Shingleton
*Attorney, Agent, or Firm*—Finnegan, Henderson, Farabow, Garrett & Dunner, L.L.P.

[57] ABSTRACT

A plasma generating apparatus has a plasma-generating vessel into which a gas is introduced. A coaxial line is inserted into the plasma-generating vessel. The coaxial line is insulated from the vessel with an insulator. The coaxial line has a central conductor and an outer conductor, to both of which microwave is supplied from a magnetron. That part of the central conductor which is located inside the plasma-generating vessel has, disposed therein, permanent magnets which form a cusp field. A seed plasma is formed around the permanent magnets by microwave discharge. A direct-current voltage is applied from a direct-voltage source between the outer conductor 24 and the plasma-generating vessel. Upon this application, electrons in the seed plasma move toward the inner wall of the plasma-generating vessel and are accelerated to ionize the gas. The ionized gas serves as seeds to cause arc discharge between the outer conductor and the plasma-generating vessel to generate a main plasma. By disposing an extracting electrode at the opening of the plasma-generating vessel, ion beams can be extracted from the main plasma.

15 Claims, 8 Drawing Sheets

PLASMA GENERATING APPARATUS AND ION SOURCE USING THE SAME

BACKGROUND OF THE INVENTION

1. Field of the Invention

The present invention relates to a plasma generating apparatus in which a seed plasma is generated by high-frequency discharge and electrons in the seed plasma are used to generate a main plasma by direct-current discharge. This invention further relates to an ion source in which ion beams are extracted from the main plasma generated by the plasma generating apparatus.

Besides being used for an ion source, such a plasma generating apparatus can be utilized as the plasma generating apparatus of a plasma-assisted CVD apparatus, plasma-etching apparatus, etc. The ion source using such a plasma generating apparatus can be utilized, for example, in an ion-doping apparatus (non-mass-separation type ion implanter) for producing liquid crystal display and in an ion-beam apparatus, e.g., an ion implanter for ion implantation into semiconductor substrates, etc.

2. Description of the Related Art

An ion source having an electron-generating chamber and a plasma generating chamber separately disposed from the chamber is disclosed, e.g., in JP-B-7-46586. (The term "JP-B" as used herein means an "examined Japanese patent publication".)

An example of the ion source described in the above reference is shown in FIG. 9. This ion source consists of: an electron-generating chamber 100 in which a plasma is generated upon introduction of a gas ( reactive gas) 102 and microwave 104 to form electrons; a plasma-generating chamber 112 connected to the electron-generating chamber 100 through an insulator 108 and an electron extracting electrode 110; and a beam extracting electrode 116 disposed at the opening of the plasma-generating chamber 112. The outer periphery of the electron-generating chamber 100 is surrounded, along the axis thereof, by a cylindrical coil 106 which generates a direct-current magnetic field (satisfying ECR conditions) for plasma confinement. Permanent magnets 114 which form a cusp field have been disposed around the plasma-generating chamber 112.

In this conventional ion source, a plasma is formed in the electron-generating chamber 100, and electrons only are extracted from the plasma into the plasma-generating chamber 112 by means of the electron extracting electrode 110. These electrons are used to cause arc discharge between the electron extracting electrode 110 and the plasma-generating chamber 112, whereby a plasma is formed within the plasma-generating chamber 112. From this plasma, ion beams 118 are extracted by means of the beam extracting electrode 116. The introduction of electrons into the plasma-generating chamber 112 is intended mainly to facilitate the initiation of arc discharge and the formation of a plasma in the plasma-generating chamber 112.

The ion source described above has a drawback that this apparatus as a whole necessarily has a large size because it has the electron-generating chamber 100 separately from the plasma-generating chamber 112.

The conventional ion source has another drawback as follows. In order to obtain ion beams 118 over a large area, the plasma-generating chamber 112 should be enlarged (made to have an increased area) and a highly homogeneous plasma should be formed in this plasma-generating chamber 112. For attaining the high plasma homogeneity, a plurality of electron-generating chambers 100 should be disposed for one plasma-generating chamber 112 to supply electrons dispersedly to the plasma-generating chamber 112 from these charge-generating chambers 100. These electron-generating chambers 100 each should be large in some degree so as to, e.g., decrease plasma loss within the same. However, it is difficult to dispose such large electron-generating chambers 100 for one plasma-generating chamber 112 while preventing the electron-generating chambers 100 from interfering with each other mechanically or magnetically. Consequently, the formation of a plasma or ion beams over a large area is difficult.

In particular, in the case of an ion source which has a cylindrical coil 106 for plasma confinement disposed outside an electron-generating chamber 100, as in the example described above, the ion source has an even larger size due to the cylindrical coil 106. Moreover, the presence of such a cylindrical coil 106 makes it more difficult to dispose a plurality of electron-generating chambers 100 for one plasma-generating chamber 112. In addition, the cylindrical coil 106 necessitates a direct-voltage source for exciting the same, and this results not only in a further increase in the size of the whole apparatus but in an increased cost.

SUMMARY OF THE INVENTION

It is an object of the present invention to provide a plasma generating apparatus in which a seed plasma is generated by a small unit without disposing an electron-generating chamber causative of size increase, such as that described above, and which as a whole can hence have a reduced size and facilitates the attainment of a larger area.

It is another object of the present invention to provide an ion source using the plasma generating apparatus.

A plasma generating apparatus according to the present invention comprises: a plasma-generating vessel into which a gas is to be introduced; one or more high-frequency lines which each is inserted into the plasma-generating vessel while being insulated therefrom, as at least one permanent magnet in its inserted part, and serves to ionize the gas to generate a seed plasma around the permanent magnet when a high frequency is externally supplied to the high-frequency line to cause high-frequency discharge in a magnetic field formed by the permanent magnet; and a direct-voltage source which serves to apply a direct-current voltage between each of the high-frequency line and the plasma-generating vessel, with the former being on a negative electrode side, to cause electrons in the seed plasma to move at an accelerated speed toward a wall of the plasma-generating vessel, so that the electrons cause direct-current discharge between each of the high-frequency line and the plasma-generating vessel to generate a main plasma within the plasma-generating vessel.

In the plasma generating apparatus described above, when a gas is introduced into the plasma-generating vessel and a high frequency is supplied to each high-frequency line inserted into the plasma-generating vessel, then high-frequency discharge occurs around the permanent magnet of the high-frequency line. The high-frequency discharge ionizes the gas present therearound to form a seed plasma around the permanent magnet. In this stage, the magnetic field formed by the permanent magnet functions to confine the seed plasma in a space around the permanent magnet and thus efficiently yield a high-density seed plasma.

A direct-current voltage is applied to between each high-frequency line and the plasma-generating vessel, which application causes electrons contained in the seed plasma to move at an accelerated speed toward the inner wall of the plasma-generating vessel. These electrons serve as seeds to cause direct-current discharge in the plasma-generating vessel, and this discharge ionizes the gas to generate a main plasma. In this stage, the electrons generated from the seed plasma serve, e.g., to facilitate the initiation of direct-current discharge and the formation of a main plasma.

As described above, according to the plasma generating apparatus of the present invention, a seed plasma can be generated in the plasma-generating vessel without the necessity of an electron-generating chamber such as that in the conventional apparatus described above, and a main plasma can be generated within the plasma-generating vessel using electrons contained in the seed plasma. In addition, each high-frequency line having at least one permanent magnet can be made to have a far smaller size than the electron-generating chamber in the conventional apparatus described above. As a result, the plasma generating apparatus as a whole can have a reduced size. Furthermore, since one plasma-generating vessel can be easily provided with two or more high-frequency lines of the above kind for the reason given above, the plasma-generating vessel can be easily made to have a large area. Therefore, it is possible to form a highly homogeneous plasma over a large area.

The ion source according to the present invention has the plasma generating apparatus described above and an extracting electrode disposed at the opening of the plasma-generating vessel of the plasma generating apparatus. This ion source as a whole can hence have a reduced size for the same reason as the above. The ion source can also be easily made to have a large area. Therefore, it is possible to extract ion beams which are highly homogeneous over a large area.

PREFERRED EMBODIMENT OF THE INVENTION

Figure 1:
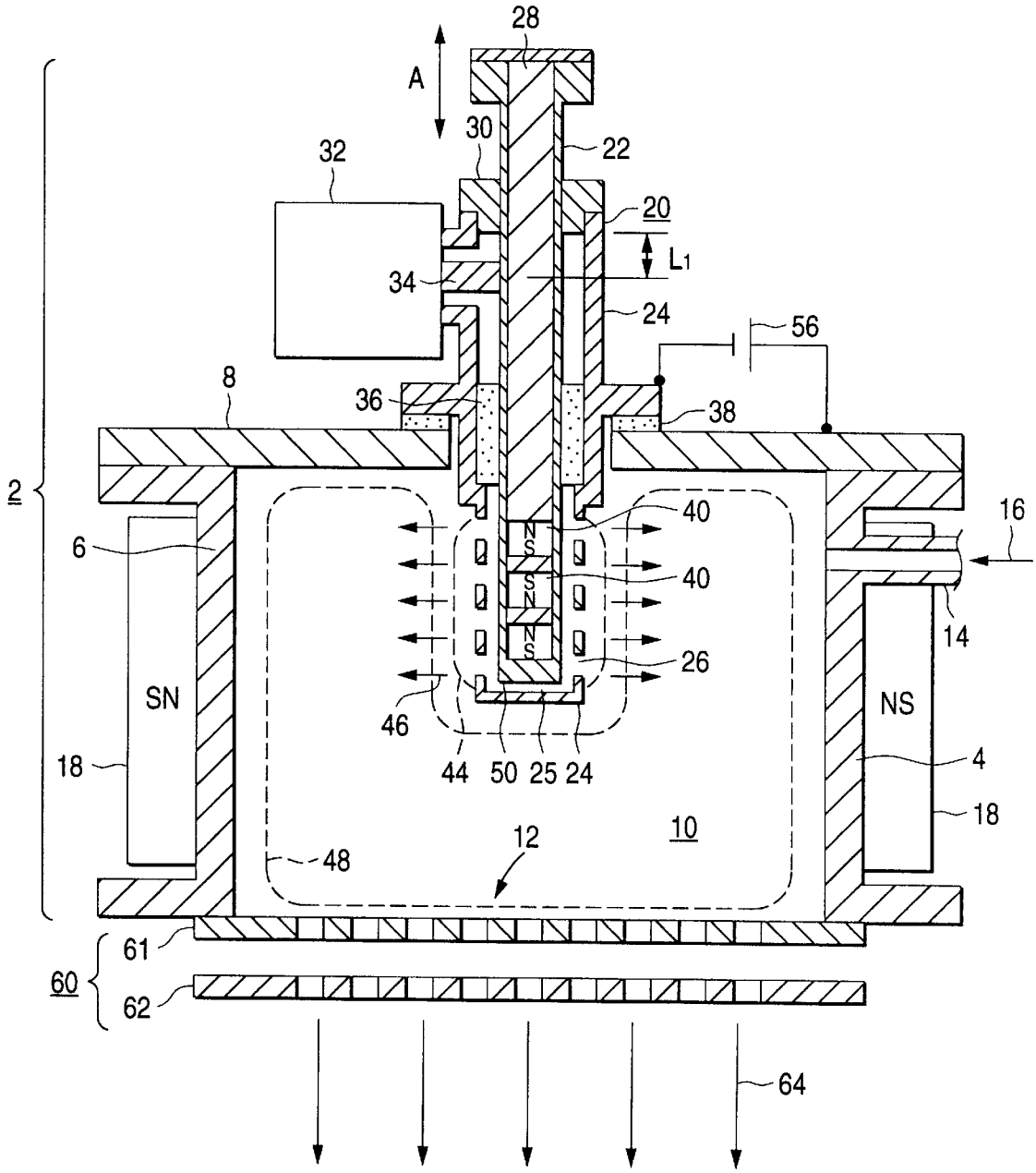
FIG. 1 is a sectional view illustrating one embodiment of the ion source employing a plasma generating apparatus according to the present invention.
Figure 2:
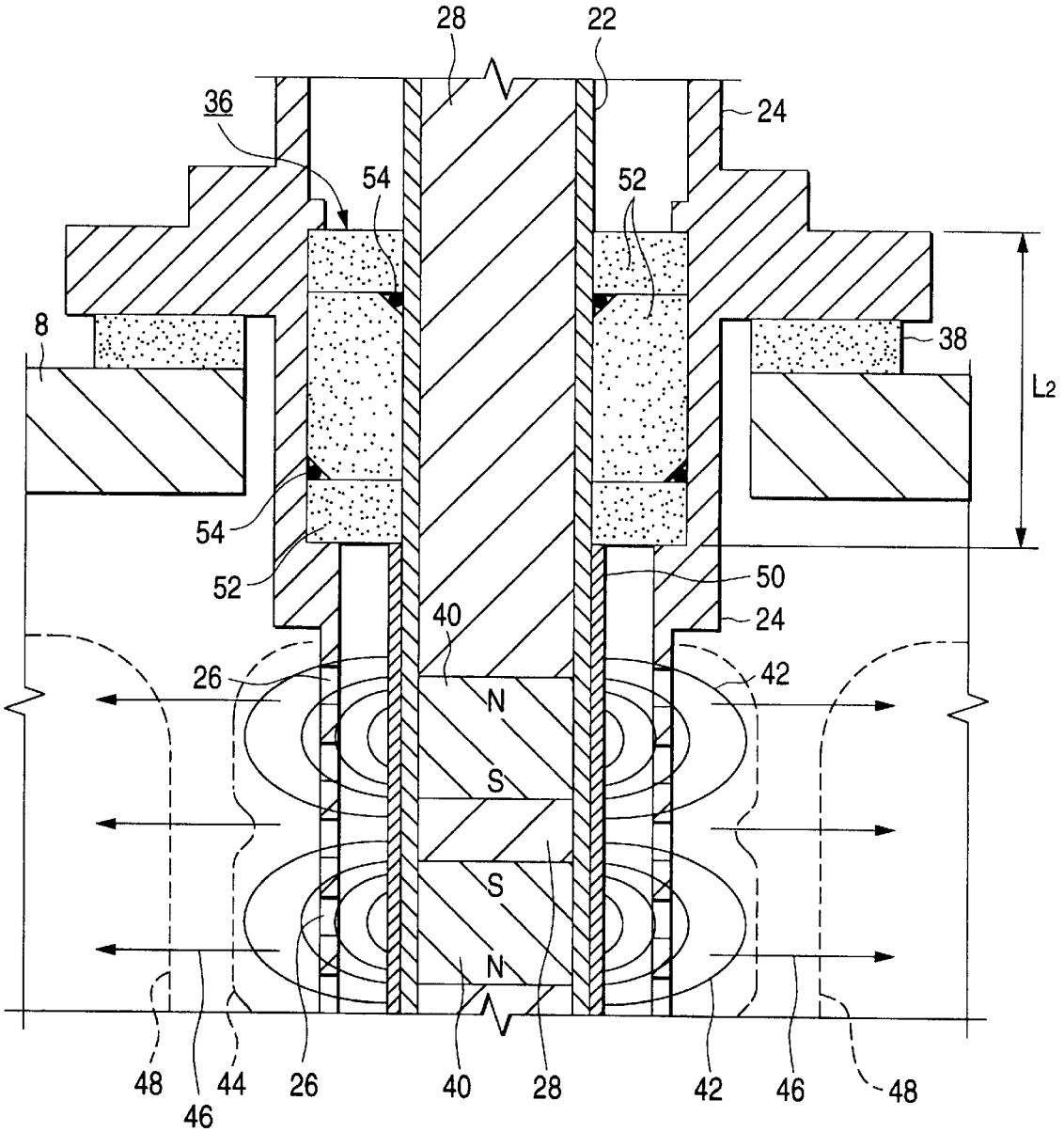
FIG. 2 is an enlarged sectional view of the ion source shown in FIG. 1 which view illustrates some of the permanent magnets and nearby components.

FIG. 1 is a sectional view illustrating one embodiment of the ion source using a plasma generating apparatus according to the present invention. FIG. 2 is an enlarged sectional view of the ion source shown in FIG. 1 which view illustrates some of the permanent magnets and nearby components.

This ion source has a structure including: a plasma generating apparatus 2 containing a plasma-generating vessel 4 having an opening 12; and an extracting electrode 60 disposed close to the opening 12. The extracting electrode 60 serves to extract ion beams 64, by the action of an electric field, from a main plasma 48 formed within the plasma-generating vessel 4.

The extracting electrode 60 in this embodiment consists of two porous electrodes, i.e., a first electrode 61 and a second electrode 62. However, the extracting electrode 60 may be constituted of one electrode or three or more electrodes. In place of the pores, one or more holes or slits may be formed in each constituent electrode.

The plasma generating apparatus 2 of this embodiment has a plasma-generating vessel 4 into which a gas 16 to be converted to a plasma is introduced through a gas inlet 14. The plasma-generating vessel 4, in this embodiment, consists of a side wall part 6 in the form of a cylinder, prism, or the like and a back plate 8 serving as a lid for the back of the side wall part 6. The plasma-generating vessel 4 has the opening 12 at its lower end. The inside of this plasma-generating vessel 4 constitutes a plasma-generating chamber 10.

The plasma-generating vessel 4 is surrounded by permanent magnets 18, which are disposed in such a manner that those magnetic poles of the individual magnets 18 which face the inside of the plasma-generating vessel 4 are arranged alternately in the order of N, S, N, . . . so as to form a cusp field around the inner wall of the plasma-generating vessel 4. Permanent magnets which form a similar cusp field may be disposed also on the outer side of the back plate 8. The plasma-generating vessel 4 is made of a nonmagnetic material so as not to disturb the magnetic field formed by the permanent magnets 18.

A coaxial line 20 as an example of the high-frequency line is inserted into the plasma-generating vessel 4, through the back plate 8 in this embodiment. This coaxial line 20 (specifically, an outer conductor 24 thereof) and the plasma-generating vessel 4 (specifically, the back plate 8 thereof) are insulated electrically (with respect to direct current) from each other with an insulator 38. This is because a direct-current voltage is applied to between the two components with, e.g., a direct-voltage source 56, which will be described later.

The coaxial line 20 in this embodiment has a central conductor 22 in a cylindrical form and an outer conductor 24 in a cylindrical form which surrounds the central conductor 22. The inside of this coaxial line 20 is hermetically separated with an insulating sealing part 36 into two parts, i.e., a part located inside the plasma-generating vessel 4 and a part on the side of the atmosphere.

The insulating sealing part 36 has insulators 52 for electrically insulating the central conductor 22 from the outer conductor 24 and O-rings 54 for hermetic sealing. In this embodiment, the insulators 52 and the O-rings 54 are arranged in a three-stage stack and in a two-stage stack, respectively, as shown in FIG. 2. Thus, enhanced hermetic sealing is attained.

Figure 7:
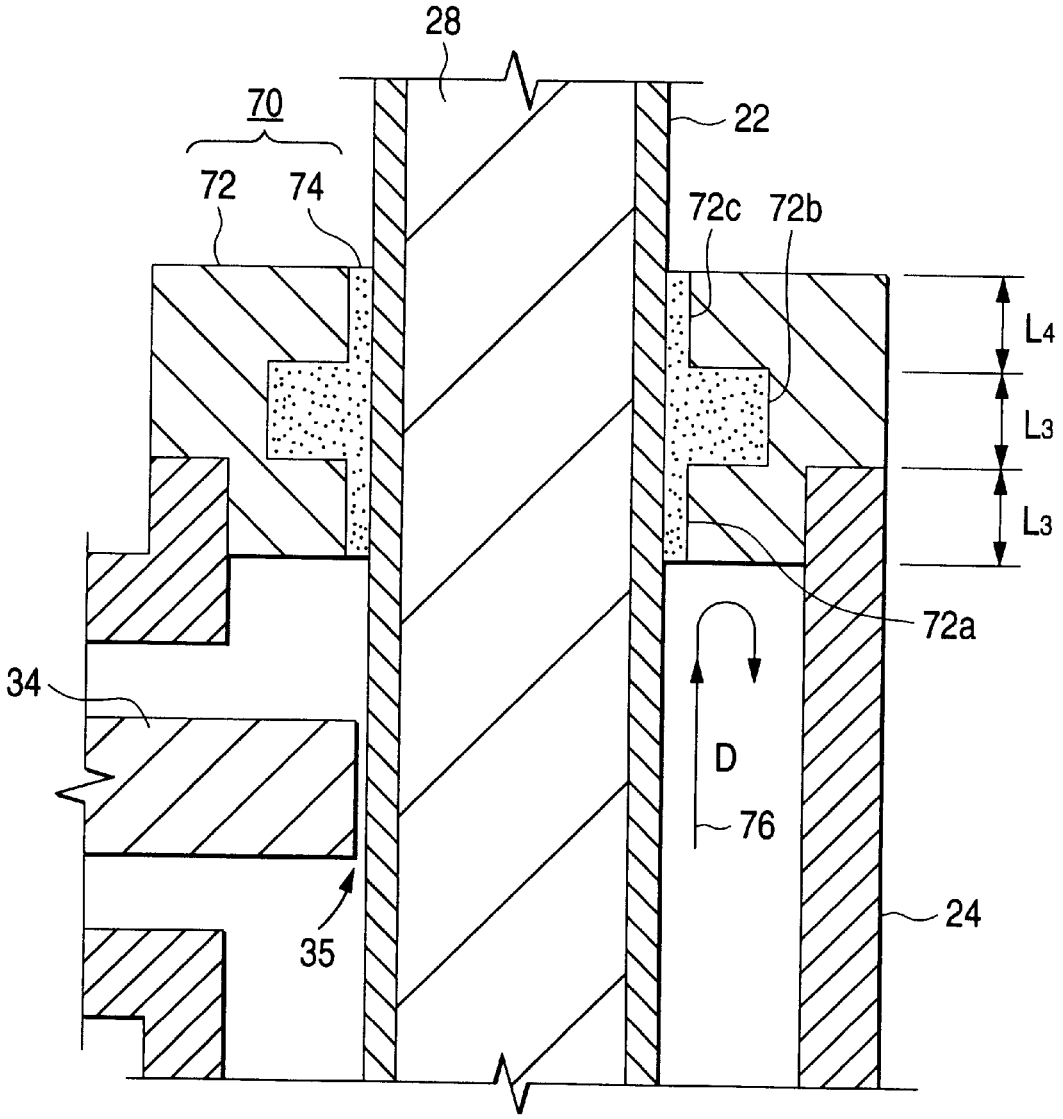
FIG. 7 is an enlarged sectional view of the ion source shown in FIG. 6 which view illustrates the direct-current-insulating short-circuiting device and nearby components.

The coaxial line 20 is connected on the atmosphere side to a magnetron 32 for supplying microwave, as an example of high frequency, to the coaxial line 20 (specifically to between the central conductor 22 and outer conductor 24 thereof). The output conductor 34 of this magnetron 32 may be in contact with the central conductor 22, or may be separated from the central conductor 22 by a small gap 35 (e.g., about 1 mm) as shown in FIG. 7. Even in the latter case, microwave can be supplied because the two conductors are electromagnetically bonded to each other. The output conductor 34 is not fixed to the central conductor 22, namely, the output conductor 34 is movable with respect to the central conductor 22, in order that the central conductor 22 be movable in the up-and-down direction indicated by arrow A for tuning, which will be described later.

In this embodiment, the magnetron 32 is directly connected to the coaxial line 20 in order to make the apparatus compacter. It is however possible, if desired and necessary, to supply microwave from a separately disposed microwave source to the coaxial line 20 via a waveguide, a matching device, a coaxial cable, etc. In the case where not microwave but another kind of high frequency is supplied to the coaxial line 20, a high-frequency oscillator may be used in place of the magnetron 32 or the microwave source. Although the coaxial line 20 in this embodiment protrudes from the plasma-generating vessel 4 (specifically, from the back plate 8 thereof) for the purpose of tuning, etc., it is, of course, possible to insert almost all of the coaxial line 20 into the plasma-generating vessel 4 to eliminate the protruding part.

The atmosphere-side end of the coaxial line 20 is an end electromagnetically fixed by means of a short-circuiting device 30 which electrically short-circuits the central conductor 22 and the external conductor 24. The other end of the coaxial line 20, which is located inside the plasma-generating vessel 4, may be a short-circuited end. In this embodiment, however, that inner end of the coaxial line 20 is an open end having a gap 25 in order to enable the central conductor 22 to be taken in and out.

The central conductor 22 of the coaxial line 20 contains permanent magnets 40 in its part located inside the plasma-generating vessel 4. At least those parts of the central conductor 22 and outer conductor 24 which are located close to the permanent magnets 40 are made of a nonmagnetic material so as not to disturb the magnetic field formed by the permanent magnets 40. In this embodiment, the central conductor 22 and the outer conductor 24 each is wholly constituted of a nonmagnetic material. The permanent magnets 40 are disposed in respective fixed positions by means of a packing 28 made of a nonmagnetic material.

Figure 3:
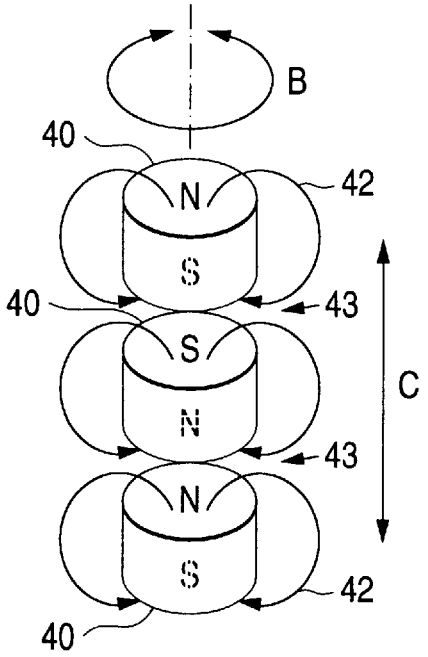
FIG. 3 is a perspective view of the permanent magnets shown in FIG. 1.

As illustrated also in FIGS. 2 and 3, the permanent magnets 40 in this embodiment are arranged along the axis of the central conductor 22 (although three permanent magnets are arranged in the embodiment shown, the number of magnets is not limited thereto) to form a cusp field around the surface of the coaxial line 20 (specifically, of the central conductor 22 thereof). More particularly, in this embodiment, cylindrical permanent magnets 40 are arranged along the length direction of the central conductor 22 in such a manner that the magnets 40 are spaced form one another and that in every two adjacent permanent magnets 40, the sides thereof facing each other have the same magnetic polarity. Lines of magnetic force 42 coming out of and into the permanent magnets 40 are schematically illustrated in FIGS. 2 and 3.

The coaxial line 20 is preferably provided with a cooling system for the permanent magnets 40 in order to remove the heat generated by, e.g., a seed plasma 44 to protect the permanent magnets 40. For this purpose, this embodiment has a water-cooled structure comprising a cooling water passageway (not shown) within the central conductor 22.

The outer conductor 24 has holes 26 at least in its part which surrounds the permanent magnets 40. Due to these holes 26, the seed plasma 44 formed inside the outer conductor 24 and electrons 46 formed therefrom can be extracted while preventing microwave from leaking out of the outer conductor 24. These holes 26 may be holes or slits, or may be many small holes. The outer conductor 24 may have a net structure, in which the openings serve as the holes. Alternatively, the outer conductor 24 may be constituted of rings vertically stacked so as to be spaced from one another; in this case, the gaps serve as the holes.

The central conductor 22 (specifically, the outer conductor 24 in this embodiment) and the plasma-generating vessel 4 are connected to a direct-voltage source 56 on its negative electrode side and positive electrode side, respectively. A direct-current voltage of e.g., about 50 to 150 V for arc discharge is applied from the direct-voltage source 56 to between the conductor 22 and the vessel 4.

The apparatus is operated as follows. The plasma-generating vessel 4 is sufficiently evacuated, for example, to a vacuum of about $5\times10^{-6}$ Torr. Thereafter, a desired gas 16 to be converted to a plasma is introduced through the gas inlet 14, and the internal pressure of the plasma-generating vessel 4 is maintained at a value suitable for direct-current arc discharge, e.g., about $2\times10^{-4}$ to $2\times10^{-3}$ Torr. When microwave is supplied from the magnetron 32 to the coaxial line 20 in the apparatus kept in that state, microwave discharge occurs between the central conductor 22 and the outer conductor 24 around the permanent magnets 40. This discharge ionizes the gas 16 present nearby to thereby form a seed plasma 44 around the permanent magnets 40. In this stage, the magnetic field formed by the permanent magnets 40 converts the orbits of electrons contained in the seed plasma 44 into spiral orbits, i.e., wind the electrons around the lines of magnetic force 42. Thus, the magnetic field formed by the permanent magnets 40 functions to confine the electrons and hence the seed plasma 44 in a space around the permanent magnets 40 to thereby efficiently yield the seed plasma 44 in a high density.

That surface of the central conductor 22 which is located inside the plasma-generating vessel 4 is preferably covered with an insulating sheath 50, as in this embodiment. This is because when electrons contained in the seed plasma 44 strike on the insulating sheath 50, the surface of the sheath 50 is negatively charged to thereby serve to repel electrons. Consequently, electrons contained in the seed plasma 44 can be inhibited from colliding against the central conductor 22 and being lost, whereby a high-density seed plasma 44 can be yielded more efficiently.

Since the electrons contained in the seed plasma 44 move along the lines of magnetic force 42 of the permanent magnets 40, they are led out of the outer conductor 24, i.e., into the plasma-generating chamber 10, through the holes 26 formed in the outer conductor 24. Therefore, a space surrounding the coaxial line 20 around the permanent magnets 40 is filled with the seed plasma 44. This space can hence be called a seed plasma generation part.

As stated above, a direct-current voltage is kept being applied from the direct-current source 56 to between the outer conductor 24 and the plasma-generating vessel 4, with the former being on the negative electrode side. Due to this direct-current voltage application, electrons 46 in the seed plasma 44 are caused to move at an accelerated speed toward the inner wall of the plasma-generating vessel 4 and, during this travel, collide with the gas 16 in the plasma-generating vessel 4 to ionize the same. The resultant ionized gas serves as seeds to cause direct-current arc discharge in the plasma-generating vessel 4, i.e., between the outer conductor 24 and the inner wall of the plasma-generating vessel 4. This arc discharge further ionizes the gas 16 to generate a main plasma 48 in the plasma-generating vessel 4. Thus, the electrons 46 released from the seed plasma 44 serve, for example, to facilitate the initiation of arc discharge in the plasma-generating vessel 4 and the formation of a main plasma.

Furthermore, since this embodiment has an extracting electrode 60, ion beams 64 can be extracted from the main plasma 48 by the action of an electric field formed by the extracting electrode 60.

As described above, according to the plasma generating apparatus 2, a seed plasma 44 can be generated in the plasma-generating vessel 4 without the necessity of providing the generator with an electron-generating chamber such as that in the conventional apparatus described hereinabove, and a main plasma 48 can be generated within the plasma-generating vessel 4 using electrons 46 contained in the seed plasma 44. In addition, since the coaxial line 20 may have a small size sufficient to contain the permanent magnets 40 built therein, it can be far smaller than the electron-generating chamber of the conventional apparatus described hereinabove. For example, the outer diameter of that part of the coaxial line 20 which is located inside the plasma-generating vessel 4 can be reduced to about 30 to 40 mm or smaller.

Therefore, the plasma generating apparatus 2 as a whole can be made to have a far smaller size than the conventional apparatus having an electron-generating chamber and a plasma-generating chamber as separate chambers.

Moreover, since the coaxial line 20 having the permanent magnets 40 built therein can be made small, the one plasma-generating vessel 4 can be easily provided with two or more coaxial lines 20 of the kind described above. Therefore, the plasma generating apparatus 2 can be easily made to have a large area and, hence, the formation of a highly homogeneous main plasma 48 over a large area and the extracting of highly homogeneous ion beams 64 over a large area are possible.

For example, in the case where a wide work (e.g., a glass substrate) is to be treated, this treatment is frequently conducted using a plasma-generating vessel 4 in the form of a rectangular prism having a length sufficient for the width of the work. The plasma generating apparatus described above can readily cope with such a case. For example, about three coaxial lines 20 each containing built-in permanent magnets 40 or about five such coaxial lines 20 are arranged in a row along the length direction of the plasma-generating vessel 4 (i.e., in the width direction of the work) when the work has a width of about 60 cm or about 100 cm, respectively. Due to this constitution, a main plasma 48 having sufficiently high homogeneity even in the length direction of the plasma-generating vessel 4 can be generated an ion beams 64 likewise having sufficiently high homogeneity can be extracted.

Figure 9:
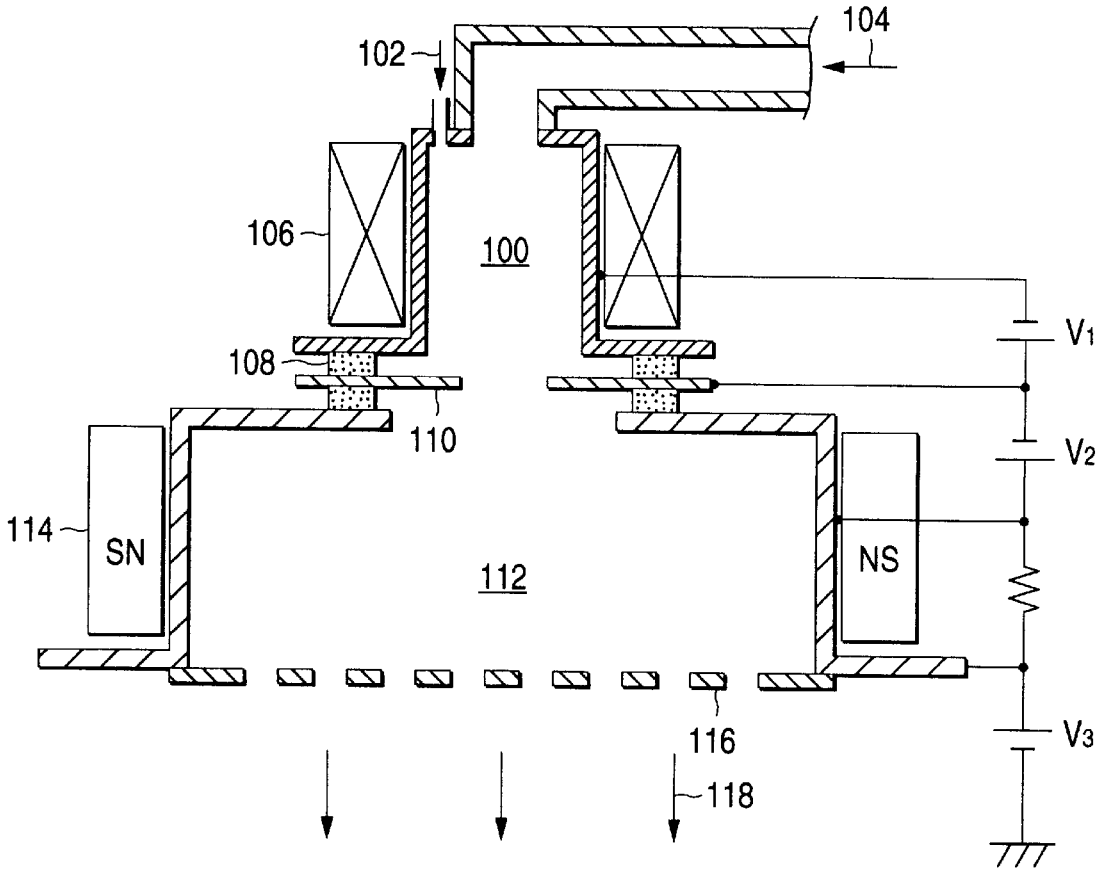
FIG. 9 is a sectional view illustrating an ion source employing a conventional plasma generating apparatus.

Still another advantage of the ion source according to the present invention over the conventional ion source shown in FIG. 9 is that a reduction in size of the whole apparatus and a cost reduction can be attained because the cylindrical coil 106, the direct-voltage source for excitation thereof, and the direct-voltage source $V_1$ for the electron extracting electrode 110 can be omitted.

In the conventional apparatus shown in FIG. 9, the cylindrical coil 106 is necessarily large because it surrounds the electron-generating chamber 100. Since the magnetic field formed by this cylindrical coil 106 stretches considerably into the plasma-generating chamber 112, it is a cause of reducing plasma homogeneity in the plasma-generating chamber 112 and, hence, of reducing the homogeneity of ion beams 118 extracted from the plasma. In contrast, in the plasma generating apparatus 2 described above, the permanent magnets 40 may be small and required to form a magnetic field only around the coaxial line 20. The magnetic field formed by these permanent magnets 40 therefore exerts almost no adverse influence on the homogeneity of the main plasma 48.

Besides being used in combination with the extracting electrode 60 as an ion source, the plasma generating apparatus 2 described above can, of course, be used alone. In this case, the plasma-generating vessel 4 may have or may not have the opening 12. For example, it is possible to place a work within the plasma-generating vessel 4 to subject the work to plasma-assisted CVD, plasma etching, etc. using the main plasma 48.

The permanent magnets 40 described above are further explained. In place of the permanent magnets 40 forming a cusp field as described above (see FIGS. 1 to 3), one slender permanent magnet 40 such as that shown in FIG. 4 or 5 may be disposed in the central conductor 22. These permanent magnets have the following advantages and disadvantages.

Figure 4:
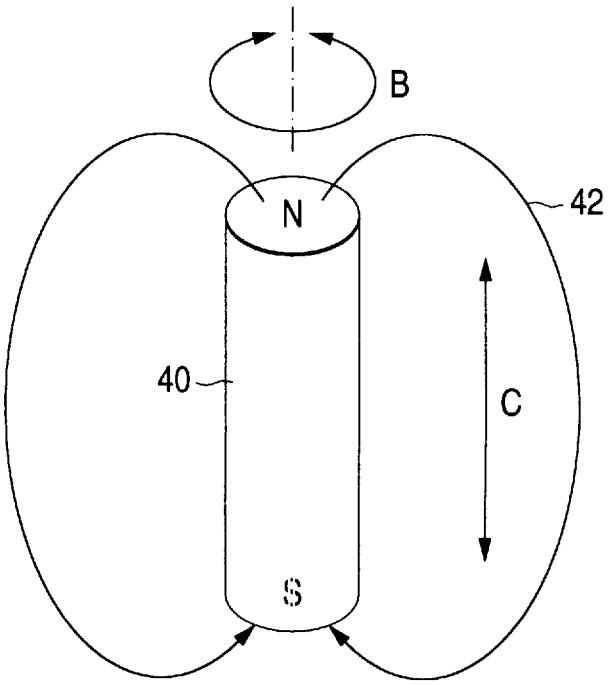
FIG. 4 is a perspective view illustrating another permanent magnet.

The permanent magnet 40 shown in FIG. 4 is in a slender cylindrical form and has N and S poles on the upper and lower ends, respectively. Even with this permanent magnet 40, a seed plasma 44 as described hereinabove can, of course, be generated around the permanent magnet 40 and confined in a space therearound by the action of the magnetic field formed by the magnet 40. In the case of this permanent magnet 40, the drift loss of electrons in the direction B perpendicular to the lines of magnetic force 42 thereof is small because there is no magnet plane in that direction. However, in the direction C extending along the lines of magnetic force 42, electrons can freely drift and hence have a relatively large drift loss. A large drift loss of electrons results in a reduced efficiency of the generation of a seed plasma 44. Furthermore, since the magnetic field thereof stretches away, this permanent magnet 48 influences a main plasma 48 in the highest degree. In addition, since the region having almost the same intensity of magnetic field is small, there is a drawback that when a magnetic field satisfying ECR (electron cyclotron resonance) conditions, for example, is to be generated around the coaxial line 20, the region which satisfies those conditions is small.

Figure 5:
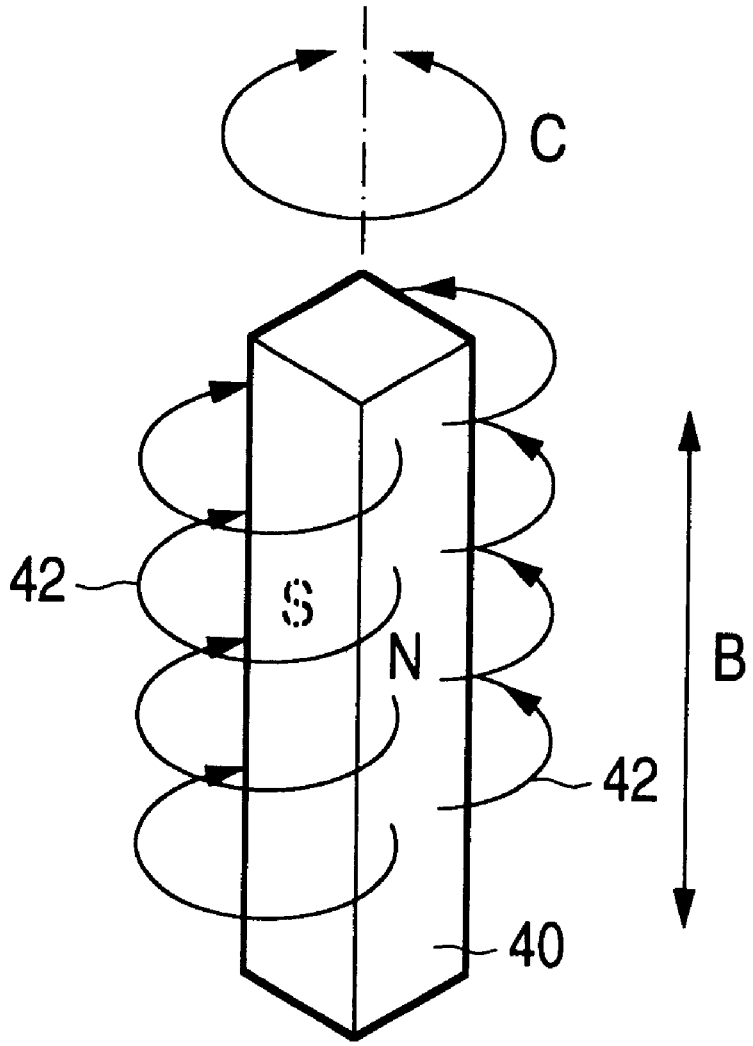
FIG. 5 is a perspective view illustrating still another permanent magnet.

The permanent magnet 40 shown in FIG. 5 is in a slender prismatic form and has N and S poles on two sides thereof opposite to each other. Even with this permanent magnet 40, a seed plasma 44 can, of course, be generated therearound and confined in a space therearound for the same reason as the above. Since the magnetic field formed by this permanent magnet 40 does not stretch away, the permanent magnet 40 exerts a limited influence on a main plasma 48. Furthermore, since the region having almost the same intensity of magnetic field is large, a large region satisfying ECR conditions can be formed around the coaxial line 20. However, the drift loss in the direction B perpendicular to the liens of magnetic force 42 is large because electrons can freely drift in that direction. In addition, since there are large magnetic-pole planes in the direction C extending along the lines of magnetic force 42, the drift loss in this direction C also is relatively large.

The permanent magnets 40 shown in FIG. 3 are those employed in the embodiment shown in FIGS. 1 and 2. In the case of these permanent magnets 40, which consist of a combination of small magnets, since the magnetic field does not stretch away, the permanent magnets 40 exert a limited influence on a main plasma 48. Furthermore, since the region having almost the same intensity of magnetic field is large, a large region satisfying ECR conditions can be formed around the coaxial line 20. Moreover, the drift loss of electrons in the direction B perpendicular to the lines of magnetic force 42 is small because there is not magnetic-pole plane in that direction. In addition, the drift loss in the direction C extending along the lines of magnetic force 42 is also small because these permanent magnets 40 form a cusp field in which electrons are repelled at each cusped part 43, where the intensity of magnetic field is exceedingly high. Consequently, among the three magnet examples described above, the permanent magnets 40 shown in FIG. 3 attain the highest efficiency of generation of a seed plasma 44 and are hence most preferred.

As stated above, it is preferred to supply microwave to the coaxial line 20 and to use the permanent magnets 40 to generate a magnetic field satisfying ECR conditions (e.g., a flux density of 875 G when 2.45 GHz microwave is applied to the coaxial line 20) in the area where a seed plasma 44 is to be generated, i.e., around the surfaces of the coaxial line 20 and central conductor 22. When the apparatus is operated in this manner, the energy of the microwave is resonantly absorbed by a seed plasma 44 and microwave absorption by the seed plasma 44 is accelerated. Consequently, a seed plasma 44 having a higher density can be generated more efficiently.

As in the embodiment shown in FIG. 1, the central conductor 22 of the coaxial line 20 is preferably made capable of being taken in and out in the direction shown by arrow S, whereby the insertion length of the central conductor 22 in the coaxial line 20 is made variable. In the apparatus having this constitution, the coaxial line 20 can be tuned with respect to resonance frequency. As a result, microwave can be efficiently supplied from the magnetron 32 to the coaxial line 20.

The distance $L_1$ between the output conductor 34 of the magnetron 32 and the short-circuiting device 30 is preferably fixed at a value almost satisfying the following equation. This is because such a value of $L_1$ enables microwave to be supplied from the magnetron 32 to the antinode of the standing wave generated in the coaxial line 20 and hence enables the microwave to be efficiently supplied to the coaxial line 20. In the following equation (1), λ is the wavelength of the microwave in each medium (the same applies hereinafter).

$$L_1=(\lambda/4)\times(2n-1),\ n=1, 2, 3, \ldots \quad (1)$$

The length $L_2$ of the insulating sealing part 36 (see FIG. 2) is preferably fixed at a value almost satisfying the following equation (2). This is because when the insulating sealing part 36 has such a length, the reflected wave from one end of the insulating sealing part 36 and that from the other end thereof have a phase difference of 180°. As a result, microwave reflection from the insulating sealing part 36 can be diminished and microwave can be efficiently supplied to the coaxial line 20.

$$L_2=(\lambda/4)\times(2n-1),\ n=1, 2, 3, \ldots \quad (2)$$

Figure 6:
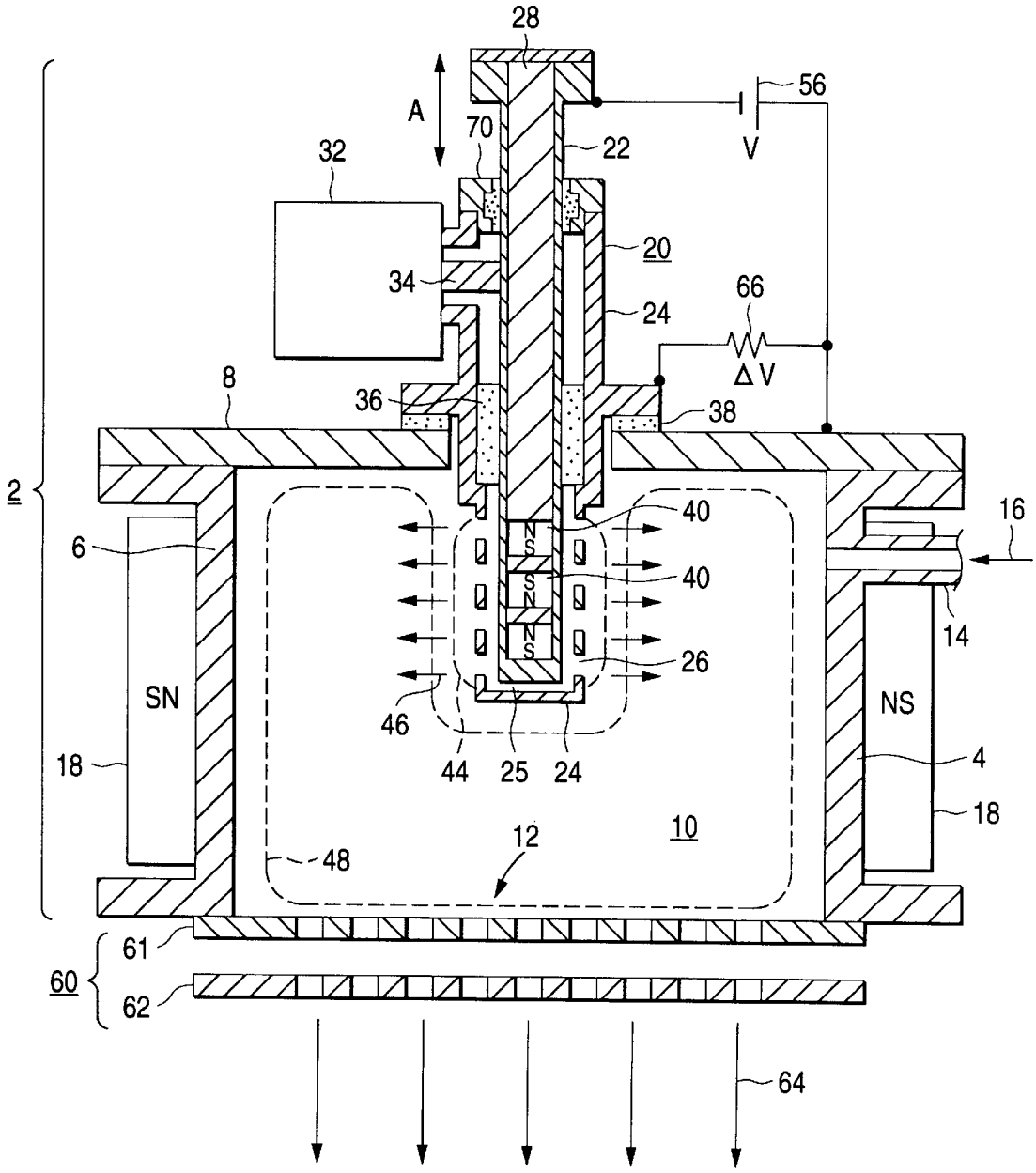
FIG. 6 is a sectional view illustrating another embodiment of the ion source using a plasma generating apparatus according to the present invention.

FIG. 6 is a sectional view illustrating another embodiment of the ion source employing a plasma generating apparatus according to the present invention. This embodiment is explained below mainly with respect to differences in structure between it and the embodiment shown in FIG. 1. In the plasma generating apparatus 2 of this embodiment, the central conductor 22 of the coaxial line 20 and the outer conductor 24 thereof are insulated from each other with respect to direct current, and direct-current arc discharge is caused between the central conductor 22 and the plasma-generating vessel 4. Furthermore, during this discharge, the potential of the outer conductor 24 is maintained at a value intermediate between the potential of the central conductor 22 and that of the plasma-generating vessel 4. Consequently, the insulating sheath 50 shown in FIG. 1, which bars discharge passageways, is omitted in this embodiment.

Illustratively stated, the outer conductor 24 has, in an atmosphere-side end part thereof, a direct-current-insulating short-circuiting device 70 in place of the short-circuiting device 30 described hereinabove. As shown in FIG. 7, this direct-current-insulating short-circuiting device 70 is composed of: a short-circuiting device 72 in the form of a ring surrounding the central conductor 22 and having a projected part 72*a*, a recessed part 72*b*, and a projected part 72*c*; and a dielectric 74 which fills the space between the short-circuiting device 72 and the central conductor 72. The dielectric 74 consists of a ceramic, e.g., alumina. With this dielectric 74, the central conductor 22 and the outer conductor 24 are insulated from each other with respect to direct current.

The projected part 72*a* and the recessed part 72*b* each has a length $L_3$ of about λ/4. When the parts 72*a* and 72*b* each has such as length, microwave 76 which is going outward from inside the coaxial line 20 can be reflected almost completely as shown by arrow D in FIG. 7. Namely, this direct-current insulating short-circuiting device 70 serves as a short-circuiting device for the microwave 76 (see Eitaro Abe, "Microwave Technology", Tokyo University Shuppan-Kai, Nov. 30, 1985, 3rd impression of 1st ed.). Although the projected part 72*c* also has a length of about λ/4 in this embodiment, the length thereof is not limited thereto. However, when the projected part 72*a* and the recessed part 72*b* are arranged alternately, the reflection of the microwave 76 becomes closer to total reflection. Furthermore, the higher the permittivity of the dielectric 74, the more the length $L_3$ can be reduced.

In this embodiment, the negative electrode of the direct-voltage source 56 is connected to the central conductor 22 of the coaxial line 20, while the positive electrode thereof is connected to the plasma-generating vessel 4. This embodiment further has an intermediate-potential resistor 66 disposed between and connected to the outer conductor 24 of the coaxial line 20 and the plasma-generating vessel 4.

In this plasma generating apparatus 2, a seed plasma 44 is formed in the same manner as in the embodiment shown in FIG. 1. Electrons 46 in this seed plasma 44 are used to cause direct-current arc discharge between the central conductor 22, serving as a cathode, and the plasma-generating vessel 4, serving as an anode, to thereby generate a main plasma 48. During the generation of the main plasma 48, part of the arc current sent from the direct-voltage source 56 flows through the intermediate-potential resistor 66 to cause a voltage drop ΔV, whereby the potential of the outer conductor 24 is maintained at a value intermediate between the potential of the central conductor 22 and that of the plasma-generating vessel 4. For example, when the direct-voltage source 56 has an output voltage of V, then the outer conductor 24 has a potential which is higher by V−ΔV than that of the central conductor 22 and is lower by ΔV than that of the plasma-generating vessel 4.

As a result, a direct-current electric field is formed between the central conductor 22 and the outer conductor 24, and this direct-current electric field enables electrons 46 contained in the seed plasma 44 formed inside the outer conductor 24 to be rapidly extracted from the outer conductor 24. Thus, the electrons 46 in the seed plasma 44 are led more efficiently into the plasma-generating chamber 10 to contribute to the generation of a main plasma 48. Consequently, a main plasma 48 can be generated more efficiently.

In place of the intermediate-potential resistor 66, an intermediate-potential power source which outputs a voltage corresponding to ΔV may be used to keep the potential of the outer conductor 24 intermediate. This intermediate-potential power source is disposed so that the negative electrode thereof is connected to the outer conductor 24, while the positive electrode thereof is connected to the plasma-generating vessel 4.

Figure 8:
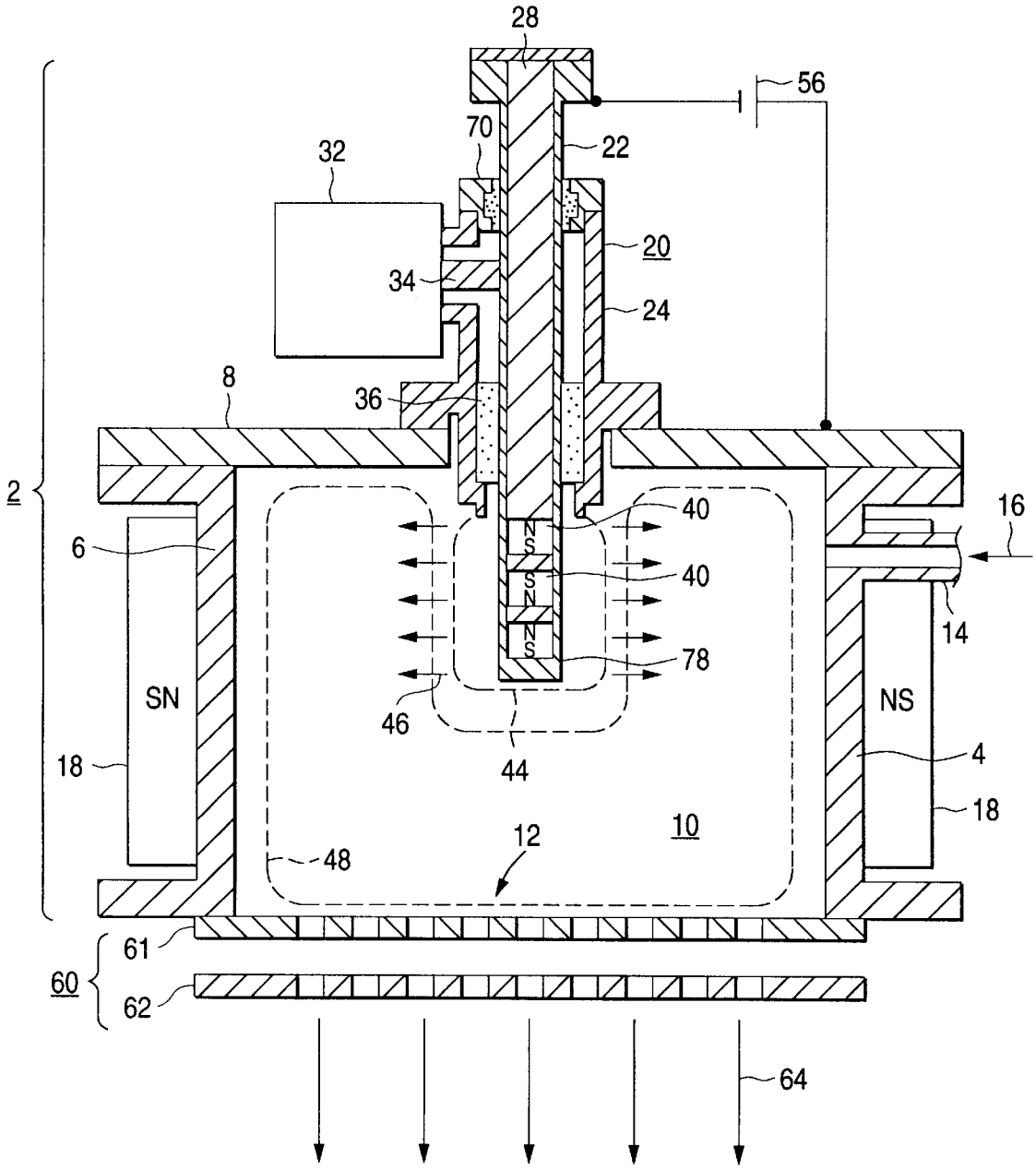
FIG. 8 is a sectional view illustrating still another embodiment of the ion source employing a plasma generating apparatus according to the present invention.

FIG. 8 is a sectional view illustrating still another embodiment of the ion source employing a plasma generating apparatus according to the present invention. This embodiment is explained below mainly with respect to differences between it and the embodiments shown in FIGS. 1 and 6. In the plasma generating apparatus 2 of this embodiment, that part of the central conductor 22 which is inserted into the plasma-generating vessel 4 is not surrounded by the outer conductor 24, but exposed to the inside of the plasma-generating vessel 4. Thus, that part of the central conductor 22 constitutes a rod-like antenna 78, which also is an example of the high-frequency line. This rod-like antenna 78 has the same build-in permanent magnets 40 as described above. Like the coaxial line 20 described above, this rod-like antenna 78 therefore has a water-cooled structure so as to protect the permanent magnets 40 from the heat generated by a plasma. Around this rod-like antenna 78, a seed plasma 44 is formed by means of high-frequency or microwave discharge in a magnetic field in the same manner as in the embodiments shown in FIGS. 1 and 6.

A direct-current voltage is applied from the direct-voltage source 56 to between the rod-like antenna 78 and the plasma-generating vessel 4, with the antenna 78 being on the negative-electrode side. Thus, electrons 46 in the seed plasma 44 are used to cause direct-current arc discharge between the rod-like antenna 78 and the plasma-generating vessel 4 to thereby generate a main plasma 48.

Although the outside of the plasma-generating vessel 4 in this embodiment need not always have a coaxial structure, a coaxial line 20 is employed here as in the embodiments described hereinabove. The outer conductor 24 of this coaxial line 20 is fixed directly to the plasma-generating vessel 4 without through the insulator 38. This outer conductor 24 and the central conductor 22 are insulated from each other with respect to direct current by means of the direct-current-insulating short-circuiting device 70 described above.

Unlike the plasma generating apparatuses shown in FIGS. 1 and 6, this plasma generating apparatus 23 does not have any wall causative of dissipation of electrons 46 (e.g., the outer conductor described above) between the seed plasma 44 and the main plasma 48. Therefore, the electrons 46 can be more efficiently used for generating the main plasma 48. In addition, because of the absence of the outer conductor 24, the seed plasma generation part can be further simplified in structure and reduced in size.

It should, however, be noted that microwave leaks from the rod-like antenna 78 into the plasma-generating vessel 4. This microwave leakage poses no problem in the case where the plasma generating apparatus has only one rod-like antenna 78. However, in the case where tow or more rod-like antennas 78 are disposed, it is preferred to interpose an isolator between each rod-like antenna 78 and the oscillator (magnetron) in order to inhibit microwave from reversely flowing from the other rod-like antenna 78 to the magnetron. In the plasma generating apparatuses shown in FIGS. 1 and 6, no microwave leakage into the plasma-generating vessel 4 occurs because the outer conductor 24 serves as a shield.

By the way, there is an idea that in the case of using a rod-like antenna 78 containing built-in permanent magnets 40 as in the embodiments described above, the direct-voltage source 56 is omitted and the seed plasma 44 is used as seeds to cause microwave discharge between the rod-like antenna 78 and the plasma-generating vessel 4 to thereby generate a main plasma 48. In this case, however, microwave having a higher intensity than that used for forming a seed plasma 44 alone should be supplied to the rod-like antenna 78. Even when microwave is supplied in this manner, mainly the seed plasma 48 located close to the rod-like antenna 78 supplies microwave power, resulting only in an increasingly elevated seed-plasma density. In addition, this seed plasma 44 is caught by the magnetic field of the permanent magnets 40 and is less apt to diffuse. Consequently, only a plasma which is highly dense in an area close to the rod-like antenna 78 and is thin in the surrounding area can be generated. Namely, it is impossible to generate a highly homogeneous plasma in the plasma-generating vessel 4.

In contrast, the embodiment described above, in which a direct-voltage source 56 is disposed and electrons 46 in a seed plasma 44 are used to cause direct-current arc discharge between the rod-like antenna 78 and the plasma-generating vessel 4, has the following advantages. Microwave having a relatively low intensity sufficient to form a seed plasma 44 may be supplied to the rod-like antenna 78. Furthermore, due to the gas-ionizing function of the direct-current arc discharge caused with electrons contained in the seed plasma 44, a highly homogeneous main plasma 48 can be generated in the plasma-generating vessel 4.

The present invention structured as above has the following effects.

According to the present invention, since a high-frequency line containing one or more permanent magnets such as those described above and a direct-voltage source are disposed therein, a seed plasma can be generated in the plasma-generating vessel without the necessity of an electron-generating chamber such as that in the conventional apparatus described above, and a main plasma can be generated within the plasma-generating vessel using electrons contained in the seed plasma. In addition, each high-frequency line having one or more permanent magnets can be made to have a far smaller size than the electron-generating chamber in the conventional apparatus described above. As a result, the apparatus as a whole can have a reduced size. Furthermore, since one plasma-generating vessel can be easily provided with two or more high-frequency lines of the above kind for the reason given above, the plasma-generating vessel can be easily made to have a large area. Therefore, it is possible to form a highly homogeneous plasma over a large area.

Moreover, as compared with the conventional apparatus having a cylindrical coil disposed outside the electron-generating chamber, the apparatus of claim 1 is advantageous in that a reduction in size of the whole apparatus and a cost reduction can be attained because the cylindrical coil, the direct-voltage source for excitation thereof, etc. are unnecessary. Furthermore, the apparatus according to the invention is free from the problem that the stretching of the magnetic field formed by the cylindrical coil reduces the homogeneity of a main plasma.

According to the present invention, since the permanent magnets form a cusp field, the ability to confine a seed plasma is enhanced and a seed plasma having a higher density can be generated more efficiently around the high-frequency line.

According to the present invention, since the permanent magnets generate a magnetic field satisfying electron cyclotron resonance conditions, the energy of microwave is resonantly absorbed by a seed plasma. As a result, a seed plasma having a higher density can be generated more efficiently around the high-frequency line.

According to the present invention, since two or more high-frequency lines are disposed for one plasma-generating vessel, a seed plasma can be generated dispersedly within the plasma-generating vessel and direct-current discharge can also be caused dispersedly within the vessel. Consequently, a highly homogeneous main plasma can be generated over a large area.

According to the present invention, since the high-frequency line comprises a coaxial line having an outer conductor having holes, high-frequency leakage into the plasma-generating vessel can be prevented. Therefore, even when two or more such coaxial lines are disposed, the coaxial lines can be prevented from suffering interference in high frequency therebetween and each coaxial line can be prevented from suffering high-frequency reverse flow from another coaxial line.

According to the present invention, since the potential of the outer conductor of the coaxial line can be kept intermediate, electrons contained in a seed plasma can be rapidly extracted from the outer conductor 24 by means of the resultant direct-current electric field. As a result, a main plasma can be generated more efficiently.

According to the present invention, since the high-frequency line comprises a rod-like antenna and there is no wall causative of electron dissipation between the rod-like antenna and the plasma-generating vessel, electrons contained in a seed plasma can be more efficiently used for generating a main plasma. Furthermore, the seed plasma generation part can be further simplified in structure and reduced in size.

According to the present invention, since the ion source comprises the plasma generating apparatus described in any one of the above claims which is provided with an extracting electrode, the ion source as a whole can be made smaller for the same reason as the above. Furthermore, the ion source can also be easily made to have a large area and, hence, highly homogeneous ion beams can be extracted over a large area.

What is claimed is:

1. A plasma generating apparatus comprising:

a plasma-generating vessel into which a gas is to be introduced;

one or more high-frequency lines which each is inserted into said plasma-generating vessel while being insulated therefrom, has at least one permanent magnet in its inserted part, and serves to ionize the gas to generate a seed plasma around said permanent magnet when a high frequency is externally supplied to said high-frequency line to cause high-frequency discharge in a magnetic field formed by said permanent magnet; and a direct-voltage source which serves to apply a direct-current voltage between each of said high-frequency line and said plasma-generating vessel, with the former being on a negative electrode side, to cause electrons in the seed plasma to move at an accelerated speed toward a wall of said plasma-generating vessel, so that the electrons cause direct-current discharge between each of said high-frequency line and said plasma-generating vessel to generate a main plasma within said plasma-generating vessel.

2. A plasma generating apparatus according to claim 1, wherein said permanent magnet is arranged in a direction along said high-frequency lien and said permanent magnet comprises a plurality of permanent magnets which form a cusp field around the high-frequency line.

3. A plasma generating apparatus according to claim 2, wherein the high frequency is microwave, and said permanent magnets generate a magnetic field satisfying electron cyclotron resonance conditions around said high-frequency line.

4. A plasma generating apparatus according to claim 1, wherein a plurality of said high-frequency lines are disposed for the plasma-generating vessel.

5. A plasma generating apparatus according to claim 1, wherein each of said high-frequency lines comprises a coaxial line which has a central conductor and an outer conductor surrounding the central conductor, the high frequency being supplied to said central and outer conductors; and further wherein said coaxial line having said permanent magnet within said central conductor in its part located inside said plasma-generating vessel, said outer conductor having holes in its part surrounding said permanent magnet, and said outer conductor of said coaxial line being connected to a negative electrode of said direct-voltage source.

6. A plasma generating apparatus according to claim 1, wherein each of said high-frequency lines comprises a coaxial line which has a central conductor and an outer conductor surrounding the central conductor, said central and outer conductors being insulated from each other with respect to direct current, the high frequency being supplied to said central and outer conductors;

further wherein said coaxial line has said permanent magnet within said central conductor in its part located inside said plasma-generating vessel, said outer conductor having holes in its part surrounding said permanent magnet, said central conductor of said coaxial line is connected to a negative electrode of said direct-voltage source; and said plasma generating apparatus further comprising intermediate-potential means for maintaining a potential of said outer conductor of said coaxial line during the generation of the main plasma at a value intermediate between a potential of said central conductor and a potential of said plasma-generating vessel.

7. A plasma generating apparatus according to claim 1, wherein each of said high-frequency lines comprises a rod-like antenna, which has said permanent magnet in its part located inside said plasma-generating vessel.

8. An ion source comprising said plasma generating apparatus according to any one of claims 1 to 7; and an extracting electrode for extracting ion beams from the main plasma formed within said plasma-generating vessel in said plasma generating apparatus, said plasma-generating vessel having an opening and said extracting electrode being disposed close to the opening.

9. A plasma generating apparatus according to claim 5, further comprising high frequency supplying means for supplying the high frequency, said high frequency supplying means having an output conductor which is movable with respect to said outer conductor.

10. A plasma generating apparatus according to claim 1, further comprising cooling means for cooling said permanent magnet.

11. A plasma generating apparatus according to claim 1, wherein said outer conductor has holes or slits at least in its part which surrounds said permanent magnet.

12. A plasma generating apparatus according to claim 5, wherein a surface of said central conductor which is located inside said plasma-generating vessel is covered with an insulating member.

13. A plasma generating apparatus according to claim 5, further comprising high frequency supplying means for supplying the high frequency, said high frequency supplying means having an output conductor;

wherein a distance $L_1$ between said output conductor and a short-circuiting device satisfies an equation:

$$L_1=(\lambda/4)\times(2n-1),\ n=1, 2, 3, \ldots$$

where, $\lambda$ is the wavelength of the microwave in each medium.

14. A plasma generating apparatus according to claim 2, wherein a length $L_2$ of an insulating sealing part satisfies an equation:

$$L_2=(\lambda/4)\times(2n-1),\ n=1, 2, 3, \ldots$$

wherein, $\lambda$ is the wavelength of the microwave in each medium.

15. A plasma generating apparatus according to claim 1, further comprising a direct-current-insulating short-circuiting device having a short-circuiting device in the form of a ring surrounding said central conductor and having a first projected part, a recessed part, and a second projected part; and a dielectric 74 which fills a spaced between said short-circuiting device 72 and said central conductor;

wherein said first projected part and said recessed part each has a length $L_3$ of about $\lambda/4$, where $\lambda$ is the wavelength of the microwave in each medium.

* * * * *